US006419623B1

(12) United States Patent
Dykes et al.

(10) Patent No.: US 6,419,623 B1
(45) Date of Patent: Jul. 16, 2002

(54) HOOD FOR INFANT CARE APPARATUS

(75) Inventors: Christopher A. Dykes, Odenton; Thomas W. Warner, Baltimore, both of MD (US)

(73) Assignee: Datex-Ohmeda, Inc, Madison, WI (US)

( * ) Notice: Subject to any disclaimer, the term of this patent is extended or adjusted under 35 U.S.C. 154(b) by 0 days.

(21) Appl. No.: 09/503,063

(22) Filed: Feb. 12, 2000

Related U.S. Application Data

(60) Provisional application No. 60/170,278, filed on Dec. 11, 1999.

(51) Int. Cl.[7] ..... A61G 11/00
(52) U.S. Cl. ..... 600/22
(58) Field of Search ..... 600/21–22

(56) References Cited

U.S. PATENT DOCUMENTS 3,782,362 A * 1/1974 Puzio ..... 600/22
3,858,570 A 1/1975 Beld et al.
4,321,913 A 3/1982 Maluta et al.
5,446,934 A * 9/1995 Frazier ..... 600/22
5,730,355 A 3/1998 Lessard et al.

* cited by examiner

*Primary Examiner*—John P. Lacyk
(74) *Attorney, Agent, or Firm*—Roger M. Rathbun

(57) ABSTRACT

An infant care apparatus is provided that includes a support for underlying the infant within the apparatus for providing care to that infant. The infant care apparatus includes a base, a generally rectangular infant platform supported on said base and has walls that extend upwardly from the base and covered with a hood to form an infant compartment for containing an infant in a controlled atmosphere. The hood is specially configured so as to have a lower edge that interfits over the walls in forming that infant compartment and has side panels that extend upwardly and inwardly from the sides of the hood and front and rear panels. The panels form an upper top surface that is also a flat, planar surface that preferably tapers outward toward the front panel and also is inclined downward at a slight angle toward the front panel. Each of the panels is a flat, planar panel that allows the caregiver good, undistorted visibility into the infant compartment to visually monitor the infant from at least the two longitudinal sides and the front of the apparatus.

15 Claims, 4 Drawing Sheets

HOOD FOR INFANT CARE APPARATUS

RELATED APPLICATION

This application is based upon Provisional Patent Application Serial No. 60/170,278 filed Dec. 11, 1999.

BACKGROUND

The present invention relates to an infant care apparatus and, more particularly, to a hood for use with an infant warming apparatus such as an incubator.

There are, of course, many devices or apparatus for the care of an infant and most have, in common, an infant compartment within which the infant is positioned within a controlled atmosphere. Typically the infant compartment has a support surface that is a generally flat, planar surface on which the infant lies and from which lateral sides extend upwardly where a top combines with the upper portion of the sides to from therein an infant compartment. The sides are normally vertical and constructed of a material that is a transparent plastic in order to afford a good view of the infant contained within the infant compartment. Thus, the hood itself may be a separate unit that simply covers the vertical side walls by means of a lower peripheral edge that engages and mates with the upper periphery of the vertical side walls or may be may be a construction that includes the vertical side walls themselves or portions thereof.

As used herein, therefore, the term hood will be used to describe the upper portion of entire structure that forms the infant compartment with the generally vertical side walls included in the structure to form the infant compartment or may only be the top portion of a construction where the side vertical walls are separately formed and the top portion can be moved with respect to those side walls to open and close the infant compartment.

Basically the configuration of the hood is important as it allows the attending personnel good visibility of the infant so that such caregivers can keep a good visual monitor of the infant within the enclosure without having to open the incubator and disrupt the atmosphere surrounding the infant. Obviously, a planar, flat surface is good for visibility similar to a flat pane of glass in a window and thus such flat surface is preferred in incubators. In addition, however, the flat planar surface needs to be disposed at an inward angle so that the nurse can look through the flat surface at about a right angle, that is, the nurse looks directly downwardly and inwardly through the flat, planar surface to see into the infant apparatus. In designing incubators, therefore, there normally is a flat, planar surface located at the height of the ergonomically determined nurse and directed inwardly at an angle such that the nurse can stand alongside the incubator and look directly through the flat, planar surface into the infant compartment. As will be seen, by inwardly, it is mean that the panels slope inwardly toward the interior of the enclosure in the upward direction.

Accordingly, various hood designs have been used, one of which is cylindrical as shown and described in U.S. Pat. No. 4,321,913 of Maluta et al. The Maluta et al incubator has no flat, planar panels and would not be amenable to the use of such panels. In the Lessard et al patent, U.S. Pat. No. 5,730,355 there is a hood configuration that has flat, angled upper panels on opposite sides of the hood but neither of the ends has a angled flat panel that would provide a good view and thus the Lessard et al hood would not afford a good view of an infant positioned within the incubator from the end of the hood. As such, while the Lessard et al construction may afford a good view from the sides of the incubator, it would not enable the caregiver to have a good, undistorted view from either end of the incubator. Thus, a caregiver cannot pass along a line of such incubators aligned in a row and see the infant through the ends of those incubators without trying to see through a vertical and not angled panel.

Finally, there is a hood design in Beld et al U.S. Pat. No. 3,858,570 that features a curved surface in the very area of the hood that would be viewed through by the caregiver in monitoring the infant and therefore would get a distorted view of that infant. Thus, in Beld et al, the goal was to achieve a dome having rounded comers whereas, in the present invention, it is the intention to provide flat, planar panels for the caregiver to look through the hood at an infant within the apparatus.

As can be seen, there is a difficulty in the present hood configurations. It is important that the view of the infant not be through distorted surfaces but preferably through a flat panel in viewing the infant and that such flat panels be provided for viewing through the sides and at least one of the ends of the infant care apparatus. The visibility through the sides afford a good view of the entire length of the infant to the personnel while the view into one of the ends allows the incubators to be aligned in rows and the personnel can walk down an aisle to be able to look into the ends of the incubators. Also with certain procedures, it is sometimes necessary for multiple viewers to be observing the procedure on the infant and it would be an advantage to have an end panel also planar and angled inwardly so as to afford that viewer a good view from the end of the incubator.

To avoid distortion, it is preferable that the person be able to look through a flat, planar inclined surface on the lateral or longitudinal sides to enable a good, undistorted view of the infant. However, as can be seen while the present incubators may have inclined flat viewing surfaces for viewing through the lateral sides, none have an additional flat, inclined surface for viewing through at least one of the ends of the apparatus.

Accordingly, it would be desirable to have an incubator having a top surface that has inclined flat, planar surfaces for viewing an infant located within an incubator compartment along the lateral, longitudinal sides as well as at least through at least one of the ends of the incubator.

SUMMARY OF THE INVENTION

Accordingly, the present invention relates to a hood for use with an infant care apparatus that provides a cover for an infant compartment to enclose the infant in a controlled environment. The hood has a generally rectangular lower edge that mates with the structure of the infant care apparatus to form that infant compartment. At least three flat, planar transparent panels extend upwardly and inwardly from the lower generally rectangular edge to form a top portion that is generally planar.

Thus, the hood can cover the infant compartment of the infant care apparatus and yet provide enhanced visibility into the infant compartment for the caregiver to be able to see the infant with a minimum of distortion of that view. With the present hood, there are at least three flat, planar surfaces that are angled with respect to a horizontal plane so that the caregiver can look directly through those panels to see the infant. The flat panels are positioned such the height of the average caregiver can generally look directly at the angled panels to see into the infant compartment. In addition, the flat, planar panels are located in at least three sides of the generally rectangular shaped hood so that the caregiver can look through the angled panels on both longitudinal sides of the infant care apparatus but also have a good view through at least one of the ends of that apparatus.

As stated, the hood can be actually part i.e. joined to or integral with the sides of the apparatus and merely be the upper portion of an overall enclosure or may be a separate hood that can be used to cover and uncover the top of an enclosure containing the infant.

In the preferred embodiment, the angle of the longitudinal planar side panels is preferably about 40–50 degrees, and more preferably about 45 degrees with respect to the horizontal plane and the angle causes the transparent panels to project upwardly and inwardly from the lower rectangular edge of the hood to ultimately form the top portion of the hood. The horizontal plane is used as a reference for the various angles of the flat, planar panels since the infant is generally positioned on a flat, planar surface that is horizontally oriented within the infant care apparatus. The front end flat transparent panel may have a different angle, that is, preferably about 50–55 degrees, or more preferably 53 degrees with respect to the vertical plane. In any instance, the angled flat, transparent panels form an acute angle with respect to a horizontal plane to enable the caregiver to see through the transparent panels without distortion.

The top of the hood is also a flat, planar surface and, in the preferred embodiment, the top is angled downwardly in the direction of one of the front end of the apparatus as will be later defined. The preferred top also widens in the same direction, that is, toward the front end panel .

These and other features and advantages of the present invention will become more readily apparent during the following detailed description taken in conjunction with the drawings herein.

DETAILED DESCRIPTION OF THE INVENTION

Figure 1:
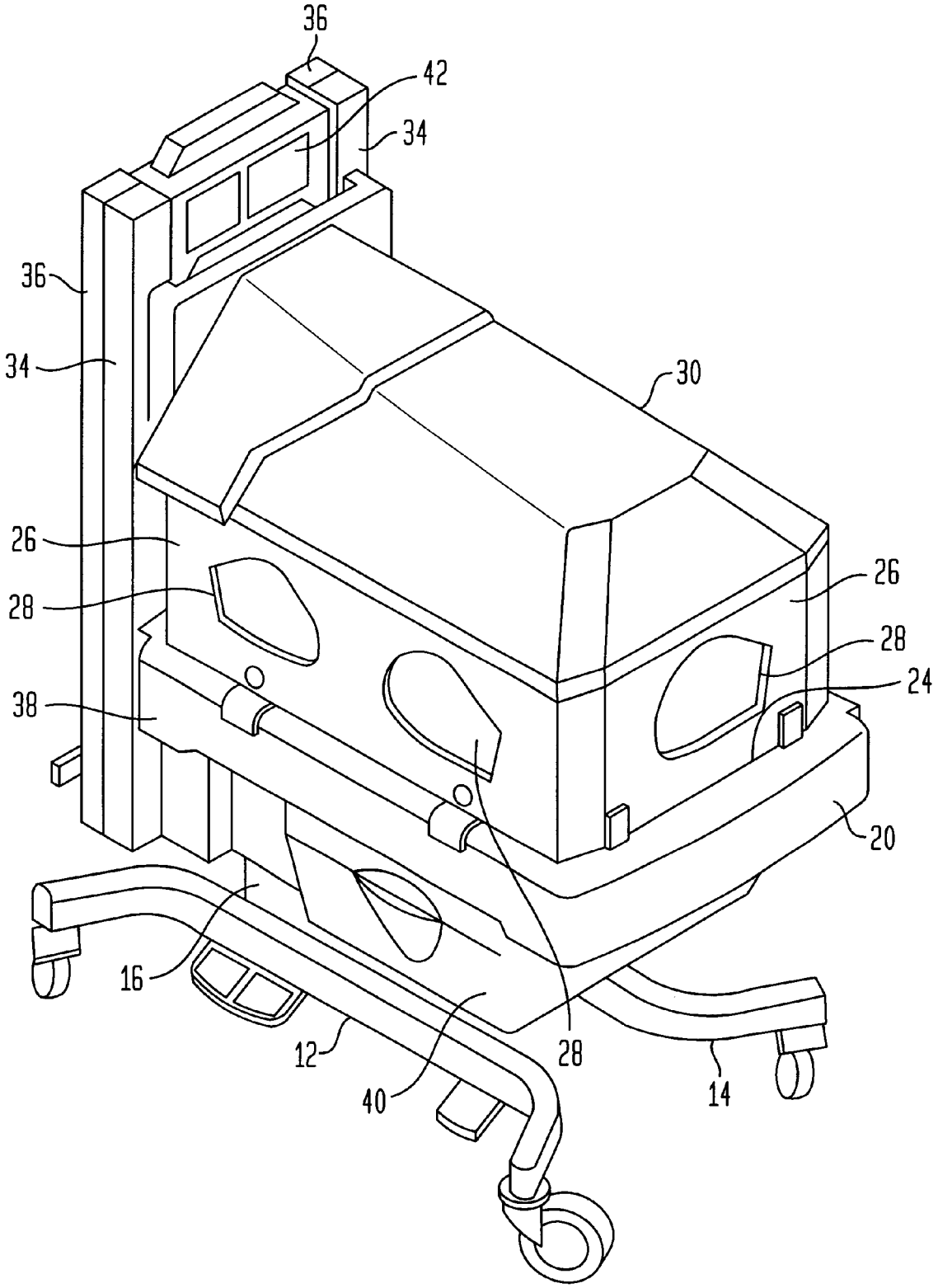
FIG. 1 is a perspective view of an infant care apparatus having a hood constructed in accordance with the present invention.

Referring now to FIG. 1, there is shown a perspective view of an infant care apparatus 10 constructed so as to use the present invention and includes a base 12 comprising a pair of U-shaped members 14 that are joined together and which provide support for a base member 16. Wheels 18 may also be provide for ready movement of the infant care apparatus 10.

An infant platform 20 is provided and which supports and infant in the infant care apparatus 10 and the infant platform 20 may be mounted in cantilever manner to the base member 16. The infant platform 20 includes a flat, planar surface 24 that underlies the infant when positioned within the infant care apparatus 10 ands which lies in a horizontal plane.

Extending upwardly around the periphery of the infant platform 20 are a plurality of walls 26, normally of a transparent plastic material and which surround the flat planar surface 24 to enclose the infant on the flat, planar surface 24. As can be seen, the walls 26 can have handholes 28 to enable the caregiver to reach the infant, however, if even more access is required to the infant, at least the side walls 26 can be dropped downwardly to open fully for complete access to the infant to carry out procedures on the infant or for introducing and removing the infant from the infant care apparatus 10.

A hood 30, when in the position as shown in FIG. 1, covers the upper peripheral edges of the walls 26 to enclose therein an infant compartment 32 that provides a controlled environment where heat and humidity can be provided an controlled to aid in the development and wellbeing of the infant. The hood 30 can be raised and lowered vertically to cover and uncover the infant compartment 32. The hood 30 is affixed to movable vertical frame members 34 that move with respect to, and interfit with stationary vertical frame members 36 and a lifting mechanism is used to move the movable vertical frame members 34 and the hood 30 upwardly and downwardly with respect to the stationary vertical frame members 36.

A heating and air moving compartment 38 is located within the infant platform 20 beneath the flat, planar surface 24 on which the infant is positioned and within the heating and air moving compartment 38 there is located the various components to make a convective heating system to provide heated air to heat the infant compartment 32 and the infant positioned therein. A drawer 40 may be positioned beneath the infant platform 20 to retain supplies or other devices needed to carry out some operation or procedure on the infant.

A control module 42 is conveniently positioned intermediate the stationary vertical frame members 36 and may include displays of various monitored parameters as well as include the various controls for operation of the functions of the infant care apparatus 10.

Figure 2:
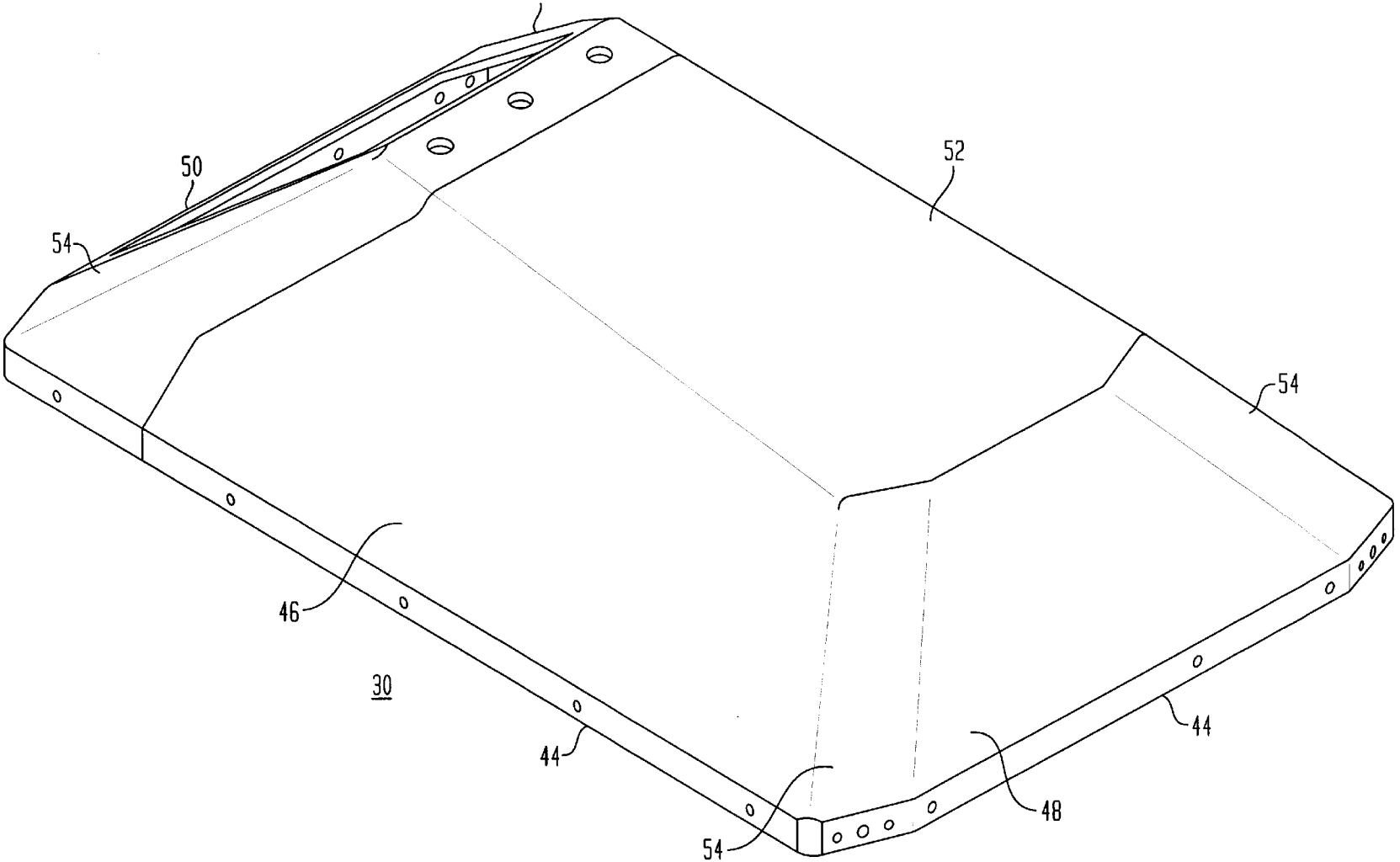
FIG. 2 is an isometric view of the hood of the present invention taken generally from above the hood.

Turning now to FIG. 2, taken along with FIG. 1, there is shown an isometric view of the hood 30, taken from above, and showing the configuration of the hood 30. Thus, as can be seen, the lower edge 44 of the hood is configured generally rectangular so as to mate with and seal to the upper peripheral edges of the walls 26 to form the infant compartment 32. Extending upwardly and inwardly from the lower edge 44 are longitudinal side panels 46, only one of which is shown in FIG. 2, that extend along the longer or longitudinal sides of the infant compartment 32. As can be seen the longitudinal side panels 46 are at an angle inwardly with respect to a horizontal plane and, in the preferred embodiment, that angle is an acute angle and, more preferably, an angle preferably of about 40–50 degrees, more preferably about 45 degrees, it being noted that the angle changes somewhat as will be later explained along the length of the longitudinal side panel 46 itself. Again, the horizontal plane is used as a convenient reference for the various angles of the hood due to the location of the infant on a generally horizontal flat, planar surface 24.

A front end panel 48 is also shown and which similarly extends upwardly and inwardly from the lower edge 44 at an acute angle with respect to a horizontal plane and preferably at an angle of about 50–55 degrees, more preferably of about 53 degrees. As shown in the Figs. the front end panel 48 is defined as the panel opposite the cantilever mounting for the hood 30 and is the panel the that the caregiver would likely be looking through in ascertaining the status of the infant.

There may be a similar rear end panel rear 50 at the opposite end of the front end panel 48, however, the rear end panel 50 may be a partial panel or specially configured to fit into the other components of the overall infant care apparatus 10. That rear end panel 50 could, however, depending upon the particular infant care apparatus, be at a predetermined angle and affixed in a similar manner as the front end panel 48.

A top 52 surface is formed at the upper ends of the longitudinal side panels 46 and the front end and rear end panels 48, 50 and the top surface is generally a flat, planar surface that slopes gently downwardly in the direction toward the front end panel 48 while, at the same time, widens slightly in the same direction. It should be again noted here that the top surface, 52, as well as the longitudinal side panels 46, and the front and rear end panels 48, 50 are all produced of a transparent material and, in the preferred embodiment, the material is an acrylic material and the entire hood 30 constructed as a one piece component.

As further noted in FIG. 2, there are intermediate flat panels 54 that are formed between the longitudinal side panels 46 and the front end panel 48 with similar intermediate flat panels 54 that are formed between the rear end panel 50 and the longitudinal side panels 46. The intermediate flat panels 54 enhance the viewing of the infant through the corners of the infant care apparatus 10 as well as lend to the feasibility of manufacturing of the hood 30 as a one piece construction. As such, the intermediate flat panels 54 provide a transition area between the longitudinal side panels 46 and the rear end panel 50 and the front end panel 48.

Figure 3:
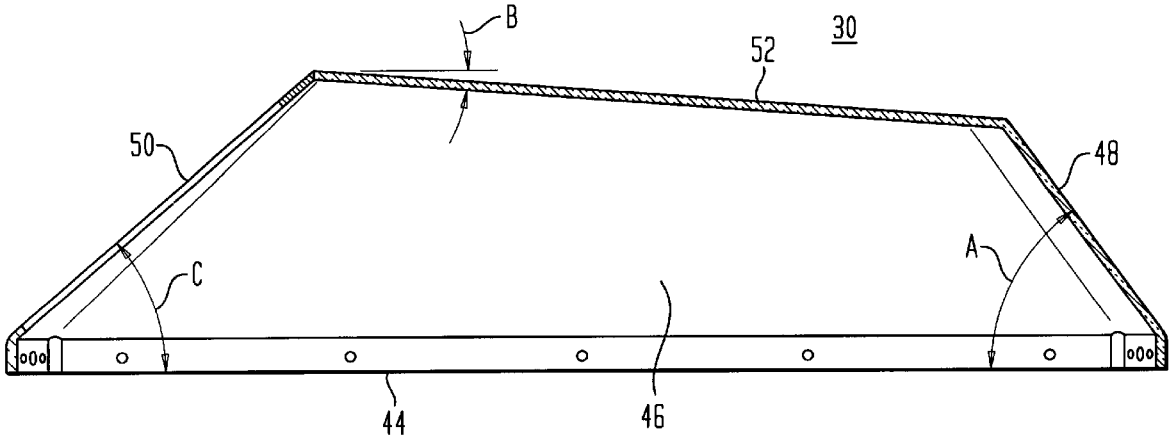
FIG. 3 is a side cross-sectional view of the hood of FIG. 2.

Turning now to FIG. 3, there is shown a side cross sectional view of the hood 30 of the present invention. As can be seen in this Fig., the front end panel 48 extends upwardly and inwardly at a predetermined angle indicated as angle A taken with respect to a horizontal plane and that angle is an acute angle, preferably about 50–55 degrees and more preferably, about 53 degrees. The angle of the rear end panel 50 is preferably slightly steeper due to the downward slope of the top surface 52 of the hood 30 in the direction toward the front end panel 48. As can be seen, the slight downward slope of the top surface is indicate by the angle B and is preferably about 4–5 degrees with respect to a horizontal plane. Finally, the rear end panel 50 is at an angle with respect to a horizontal plane as indicated by the angle C and that angle is preferably about 35–45 degrees, and more preferably about 40 degrees. The horizontal plane may also be with reference to the lower edge 44 of the hood 30 that, in the preferred embodiment, lies in a generally horizontal plane when installed in the infant care apparatus 10.

In each instance of the panels, the angle is with respect to a horizontal plane as the flat, planar surface 24 on which the infant rests in the infant compartment 32 lies in a generally horizontal plane and the specific angles are therefore determined by the height of the infant care apparatus 10 itself and the position of the infant within the apparatus. The determination of the various angles also takes into account the average height of a caregiver or nurse that would be attending to the infant and who would be visually monitoring the infant within the infant care apparatus 10. The average height of the nurse is determined by an ergonomic statistical analysis of a nurse in order for the designer of infant care apparatus to arrive at the preferred angles of the front and rear end panels 48, 50 as well as the angle of the longitudinal side panels 46.

Figure 4:
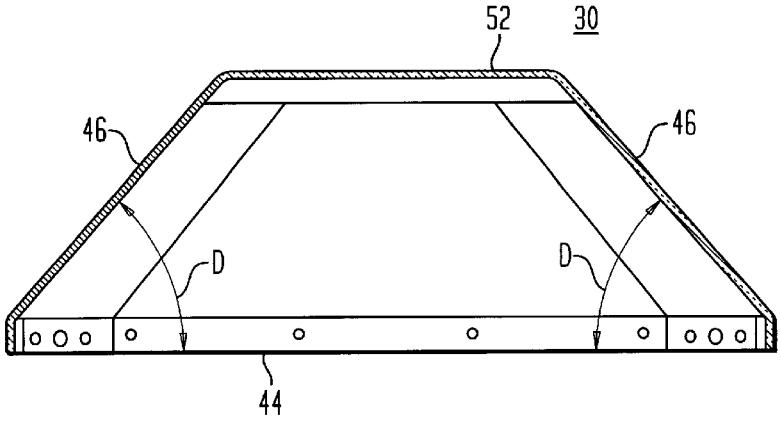
FIG. 4 is an end cross sectional view of the hood of FIG. 2.

Accordingly, in FIG. 4, there is shown an end cross sectional view of the hood 30 constructed in accordance with the present invention and the angle of the longitudinal side panels 46 with respect to a horizontal plane are indicated by the angle D, and again, that angle is an acute angle and preferable an angle of about 40–50 degrees, more preferably at an angle of about 45 degrees.

Figure 5:
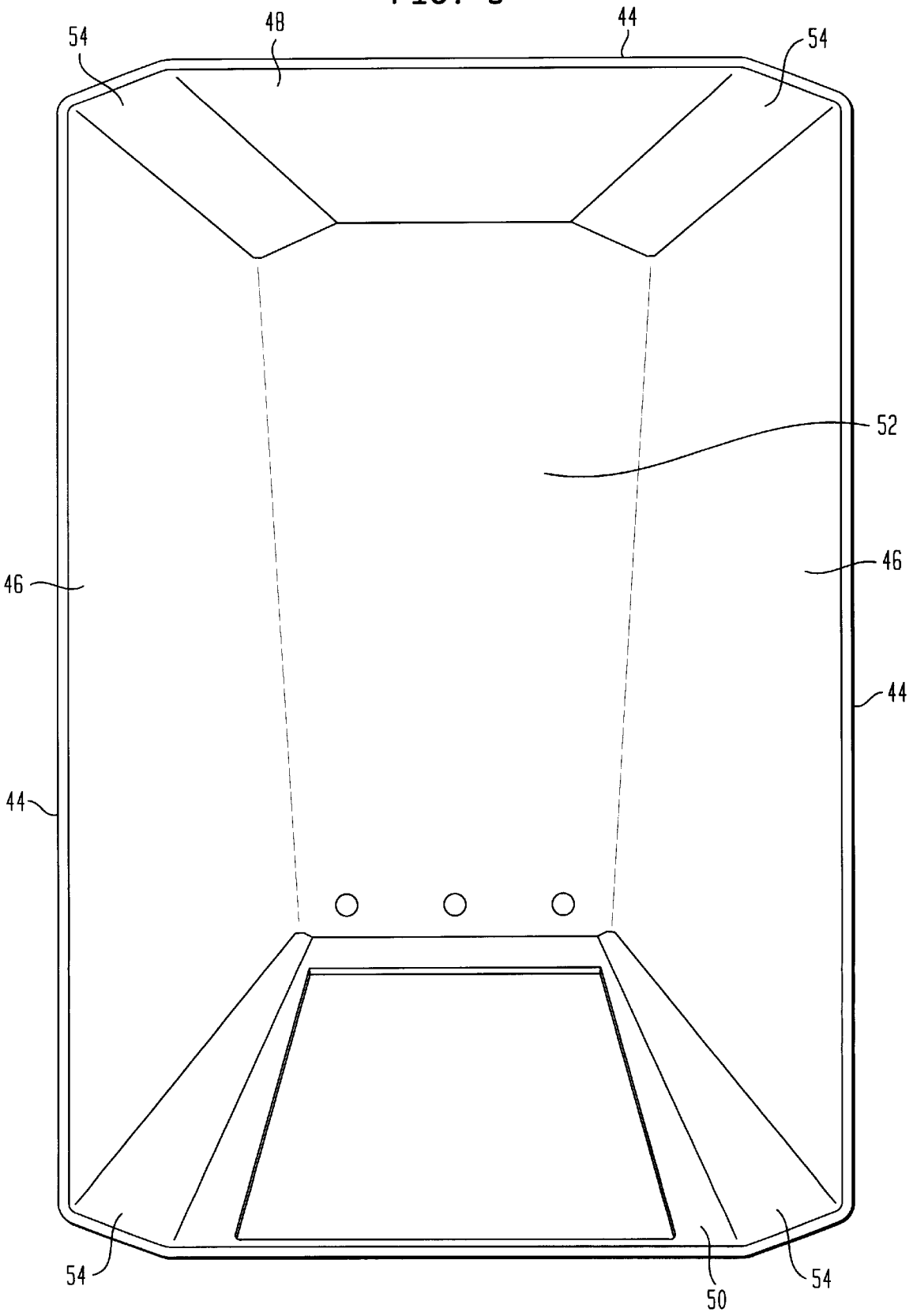
FIG. 5 is a bottom view of the hood of the present invention.

Finally, turning to FIG. 5, there is shown a bottom view of the hood 30 of the present invention and which show the outwardly tapering width of the top surface 52 in the direction of the front end panel 48, that is, the width of the top surface 52 generally widens slightly in the direction toward the front end panel 48. While preferable, since that widening provides a better viewing surface at the front end panel 48, the top surface 52 can also be simply rectangular such that the longitudinal sides of the top surface 52 are parallel to each other and to the longitudinal sides of the infant compartment 32.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. A hood for covering an infant compartment having a base, said hood comprising a generally rectangular lower edge defining a horizontal plane adapted to fit over said base to form said infant compartment, said hood further comprising-planar transparent longitudinal side panels, a rear panel and a planar transparent front end panel extending upwardly and inwardly from said generally rectangular lower edge at an acute angle with respect to the horizontal plane and forming a generally planar top surface that tapers outwardly in width toward said front end panel.

2. A hood for covering an infant compartment as defined in claim 1 wherein said longitudinal panels are at an angle of about 40 to 50 degrees with respect to the horizontal plane.

3. A hood for covering an infant compartment as defined in claim 3 wherein said longitudinal panels are at an angle of about 45 degrees.

4. A hood for covering an infant compartment as defined in claim 1 wherein said front end panel is formed at an angle of about 50 to 55 degrees with respect to the horizontal plane.

5. A hood for covering an infant compartment as defined in claim 4 wherein said front end panel is formed at an angle of about 53 degrees.

6. A hood for covering an infant compartment as defined in claim 1 further comprising intermediate flat transparent panels formed between said longitudinal side panels and said front end panel.

7. A hood for covering an infant compartment as defined in claim 1 wherein said hood is a one piece molded plastic material.

8. A hood for covering an infant compartment as defined in claim 1 wherein said top surface is in a plane angled slightly downwardly in the direction of said front end panel.

9. A hood for covering an infant compartment as defined in claim 8 wherein said top surface is angled downwardly at an angle of about 4–5 degrees with respect to the horizontal plane.

10. An infant care apparatus, said apparatus comprising a base, a generally rectangular infant platform supported on said base, said apparatus including walls extending upwardly from said infant platform to form a generally rectangular peripheral upper edge, a hood having a generally rectangular lower edge having opposite longitudinal sides and opposite front and rear ends defining a horizontal plane, said hood adapted to interfit with said peripheral upper edge of said walls to form therein an infant compartment for containing an infant in a controlled environment, heating and air moving compartment located beneath said infant platform and adapted to introduce heated air into said infant compartment, said hood having longitudinal flat, transparent panels extending upwardly and inwardly from said longitudinal opposite sides of said lower edge at a predetermined acute angle with respect to the horizontal plane, said hood further having a front end flat, transparent panel extending upwardly and inwardly from said front end of said lower edge at a predetermined angle with respect to the horizontal plane, and a rear panel, said front, rear and longitudinal panels forming a top flat, planar surface, wherein said top, planar surface widens in the direction toward said front panel.

11. An infant care apparatus as defined in claim 10 wherein said top planar surface slopes downwardly with respect to the horizontal plane in the direction toward said front panel.

12. An infant care apparatus as defined in claim 11 wherein said longitudinal panels extend upwardly and inwardly from said longitudinal opposite sides of said lower edge at an angle of about 40 to 50 degrees with respect to the horizontal plane.

13. An infant care apparatus as defined in claim 12 wherein said front end panel extends upwardly and inwardly from said front end of said lower edge at an angle of about 50–55 degrees with respect to the horizontal plane.

14. An infant care apparatus as defined in claim 13 wherein said hood is a one piece molded plastic material.

15. A hood for covering an infant compartment having a base, said hood comprising a one piece molded plastic construction having a generally rectangular lower edge defining a horizontal plane and adapted to fit over the base to form the infant compartment, said hood further comprising planar transparent longitudinal side panels, a planar transparent rear panel and a planar transparent front end panel extending upwardly and inwardly from said generally rectangular lower edge at an acute angle with respect to the horizontal plane, a generally planar top surface, said longitudinal side panels, said rear panel and said front end panel all intersecting with said generally planar top surface at an acute angle to form said generally planar top surface.

* * * * *